US005269441A

United States Patent [19]

O'Meara

[11] Patent Number: 5,269,441

[45] Date of Patent: Dec. 14, 1993

[54] DUAL CHAMBER MEDICAMENT DISPENSER HAVING A PLEATED COMMON WALL

[75] Inventor: John R. O'Meara, Jamesburg, N.J.

[73] Assignee: CP Packaging, Inc., Sub. of Wheaton Industries, Jamesburg, N.J.

[21] Appl. No.: 828,516

[22] Filed: Jan. 31, 1992

[51] Int. Cl.[5] ..... B65D 35/24

[52] U.S. Cl. ..... 222/94; 222/145; 222/215; 215/6; 220/530

[58] Field of Search ..... 222/94, 107, 215, 145; 215/6; 220/530, 500, 85 B

[56] References Cited

U.S. PATENT DOCUMENTS

| | | | |
|---|---|---|---|
| 1,363,064 | 12/1920 | Stegath | 222/94 |
| 1,894,115 | 1/1933 | Murphy | 222/94 |
| 3,182,728 | 5/1965 | Zabriskie | 222/94 X |
| 4,089,437 | 5/1978 | Chutter et al. | 222/94 |
| 4,884,703 | 12/1989 | O'Meara | 215/6 |
| 5,076,464 | 12/1991 | Simon | 222/94 X |

*Primary Examiner*—Andres Kashnikow

*Assistant Examiner*—K. DeRosa

*Attorney, Agent, or Firm*—Eugene E. Renz, Jr.

[57] ABSTRACT

A dual compartment container assembly having two adjacent compartments separated by a common wall segment. The container includes a discharge end on the container which is operable to permit dispensing of the contents of the container. The container also includes a filling end on the container which is sealed after contents are placed in the compartments. The adjacent compartments have outer arcuate walls extending from junctions with the common wall segment to form bellows like compartments with the arcuate walls being joined at each junction with the common wall segment to form axially aligned pivotal junctions. In a preferred embodiment, the common wall segment is pleated to have a first length prior to filling and a second unpleated longer length after the filling end is sealed. This forms a straight line seal at the filling end and defines the bellows part of the compartments which therefore taper outwardly from the straight line seal to the discharge end of the container.

5 Claims, 2 Drawing Sheets

DUAL CHAMBER MEDICAMENT DISPENSER HAVING A PLEATED COMMON WALL

FIELD OF THE INVENTION

The present invention relates to double compartment closure assemblies in which materials are stored in at least two separate compartments until the compartments are opened for use. More particularly, the invention relates to a construction of the closed or filling end of such a dual chamber device in a manner which facilitates the discharge of materials therefrom at a later time when access to the contents of the chambers is desired.

BACKGROUND OF THE INVENTION

The field of cap and tube assemblies which carry medicines, vitamins and the like, have become of major importance and interest in the pharmaceutical industry. There are many such devices, and recently interest has focused on those applications in which two ingredients are kept separate from one another in a single container, such as in a dual chamber dispensing package. At the appropriate time, the multiple components can be used for the intended purpose. Prepackaging of specific doses or quantities is important to save time during the application of medicine or chemicals which need to be mixed promptly or in precise quantities.

Often times, potent drugs which rapidly deteriorate when mixed together are easily and safely maintained in dual chambers to avoid premixing. Since these drugs are often used by geriatric patients who may be limited in their ability to mix in accurate proportions, it is particularly advantageous for them to have the drugs kept apart and mixed accurately just before use.

Multiple container closures are not new per se. In my prior patent, U.S. Pat. No. 4,884,703, a double compartment closure and tube assembly is disclosed which has certain features which have been found to be quite acceptable in a number of markets. Specifically, may patent discloses a container with two adjacent compartments having a common surface at one end with a thin wall portion at that end for each surface. The cap slidable fits on the end of the container and includes puncture means or piercers which are in alignment with the walls so that the movement of the cap will cause the piercers to puncture the thin wall portion of each compartment. The cap is placed in a first position on the end of the container by cooperation between an interference surface and a surface of resistance. Typically, those surfaces are formed by a ring and groove arrangement.

Another dual compartment container is described in my co-pending application titled DUAL CHAMBER DISPENSING PACKAGE, filed Oct. 30, 1991, and having Ser. No. 07/784,964. In this application, a multiple compartment chamber is disclosed which is normally sealed at one end, such as by a crimp seal, and has a discharge opening at the other end. At least two adjacent compartments are provided for chemical reactants, medicines and the like. Each compartment is aligned at the discharge end and has a thin wall dispensing port for discharge of the contents once the thin wall has been broken.

The device further includes a cap which is sized to moveably fit on the discharge end of the container and includes puncture means which are positioned in alignment with the thin wall dispensing ports. The cap and discharge end of the container cooperatively include location means for positioning the cap at a first position on the end of the container to prevent inadvertent movement of the cap. The locating means also permits intentional movement of the cap to a second position to thereby cause the puncture means to puncture the ports.

The device in my co-pending application contemplates the use of bellows means which are formed from the compartments for applying a discharge force to the individual compartments upon squeezing the container. In a preferred embodiment, there are two compartments sharing a common wall which are axially aligned and pivotally joined. These two compartments form a hinge point. Thus, particularly when high viscosity fluids are employed, squeezing the walls of the containers causes the bellows to force fluid out of the discharge ports at a much faster fate than would be achieved by gravity alone.

In most cases when the compartments are made from plastic or other quite flexible materials, designs of the type described above are admirably suited for their intended purposes. Medicines and the like are effectively dispensed and the precise quantity of contents needed is placed at the point where it is most needed. This design is particularly effective in providing precise proportions of two or more ingredients at the point where it is dispensed while at the same time providing a positive force for dispensing the contents. The bellows principle has been found to be particularly helpful, especially with different quantities or viscosities of the two or more fluids in the various containers.

The only drawback to the general field of multiple compartment containers is that sometimes the materials from which the containers are manufactured is too stiff or too inflexible. When small container chambers are needed, for example when eye drops, vitamins, or other small dosage medicines and treating fluids are dispensed, the material from which the containers are formed may prevent ease of sealing. Specifically, when designs such as described in my co-pending application and in my aforementioned U.S. Pat. No. 4,884,703 and others are employed, it is sometimes difficult to seal the end which is used for filling the containers. When bellows like structures are used, particularly on small or stiff compartments, the stress on the end which is to be sealed is potentially too great to permit a complete and effective seal to be achieved.

Accordingly, it is an object of this invention to provide a simple and effective design for dual compartment containers which permits a safe and complete seal of the filling end of the container.

Another object of this invention is to provide a sealing system for dual compartment containers which are small and relatively inflexible compared to larger containers.

Yet another object of this invention is to provide a seal design for use with dual compartment containers which employ pressure dispensing features such as bellows shaped containers and the like.

Other objects will appear hereinafter.

SUMMARY OF THE INVENTION

It has now been discovered that the above and other objects of present invention may be accomplished in the following manner. Specifically, a dual compartment container assembly has been discovered which includes two adjacent compartments which are separated by a common wall segment. The container includes a discharge end which is operable to permit dispensing of the contents of said container, and a filling end which is sealed after contents are placed in said compartments.

The two adjacent compartments have outer arcuate walls which extent from the common wall segment to form the compartments. The common wall segment has a first length prior to filling and a second longer length after the filling end is sealed to form a seal at the filling end. In a preferred embodiment, the common wall segment is pleated to have a first length prior to filling and a second unpleated longer length after the filling end is sealed.

The arcuate walls are joined to the common wall segment at each junction to form axially aligned pivotal junctions which allow the compartments to function as bellows means. The compartments and the common wall segment define the bellows means by causing the compartments to taper outwardly from the straight line seal to the discharge end of the container which is the largest diameter that the container has. Thus, as pressure is applied to the sides of the compartments, the arcuate walls function as bellows to force the contents out through the discharge end as desired.

To maximize the discharge force of the bellows means, it is desirable to have the common wall segment and the junction with the arcuate wall form a straight line seal at the filling end. Preferably, the container is made from a moldable material such as plastic, and is sealed using a heat seal. The container of the present invention is admirably suited for small capacity designs because the common wall segment accommodates arcuate walls of almost any small dimension without requiring unreasonable or possibly damaging force when the seal is made.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
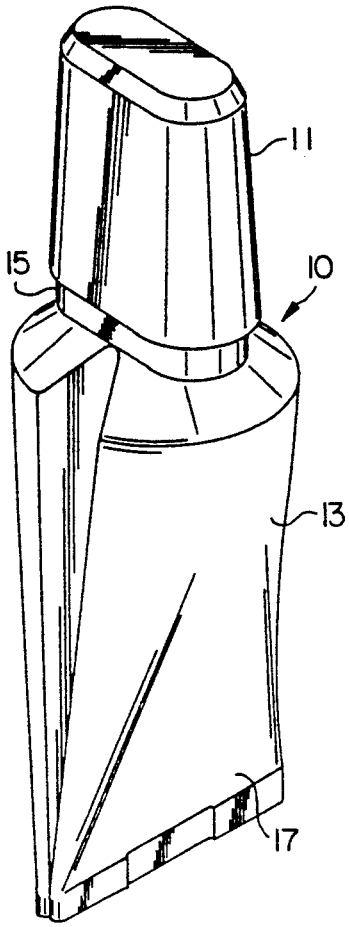
FIG. 1 is an enlarged, isometric view of a molded one-piece dual chamber tube for a package showing the discharge end of the tube covered by a closure member and the opposite end of the tube having a line seal.

As is noted in the drawings, the assembly of this invention is shown generally by the reference number 10. The container assembly includes a cap 11 which fits on tube 13 at the discharge end 15 as described in my previously identified U.S. Pat. No. 4,884,703 and my co-pending application titled DUAL CHAMBER DISPENSING PACKAGE, filed Oct. 30, 1991, and having Ser. No. 07/784,964. Both the patent and the application show dual compartment container assemblies which are suitable for use with the present invention.

The present invention differs from the above referenced inventions because it deals with the filling end 17 of the container assemblies. The contents of these container assemblies are removed when needed through discharge ports 19 and 21 on discharge end 15 as described in my patent and my application.

The container assembly of the present invention includes two adjacent compartments 23 and 25 which contain the contents after filling has been completed and before the assembly is used. Compartments 23 and 25 extend from a sealed end 27 to a full or top portion 29 of each compartment 23 and 25. Compartment 23 includes an arcuate outer wall 31 and compartment 25 includes a similar arcuate outer wall 33. In the embodiment shown in the drawings, the compartments 23 and 25 and the arcuate outer walls 31 and 33 respectively are the same size and the assembly is symmetrical. This is preferred for simplicity of manufacture, but it is recognized that the two compartments 23 and 25 could be of different sizes without departing from the spirit and scope of the present invention.

Figure 4:
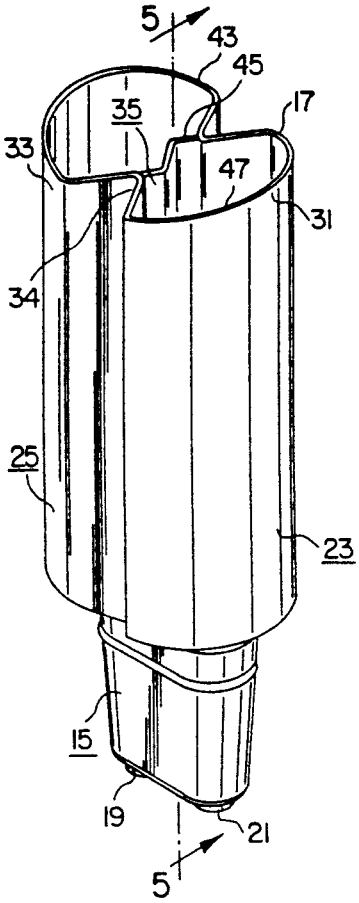
FIG. 4 is an isometric view of the molded one piece dual chamber container assembly of the invention in an inverted or filling mode.

Turning now to FIG. 4, the filling end 17 is shown open and ready to receive the contents. Normally, the filling operation is automated and contents are measured and dispersed into the containers 23 and 25 automatically, followed immediately by a sealing step in order to preserve the integrity of the contents. The container assemblies of the present invention are normally manufactured from plastics which are thermoplastic rather than thermoset in nature. Manufacturing may be by any conventional process such as by injection molding. The filling end 17 is therefore suitable for heat sealing as will be described. Heat and pressure are normally all that is needed to seal container assemblies of this construction.

Figure 5:
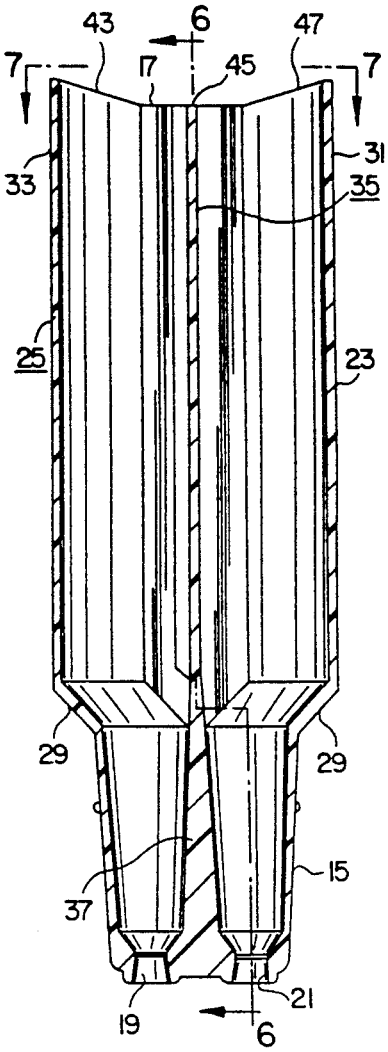
FIG. 5 is an enlarged, sectional, elevational view of the molded container assembly taken along the line 5,5 of FIG. 4
Figure 6:
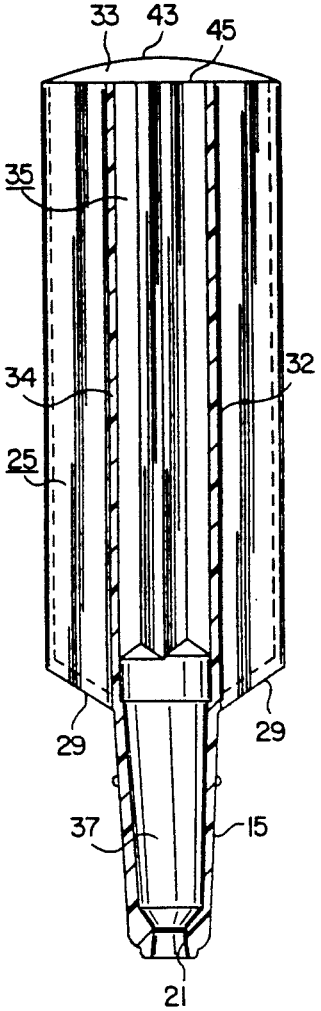
FIG. 6 is a sectional elevational view taken on the line 6,6 of FIG. 5.
Figure 7:
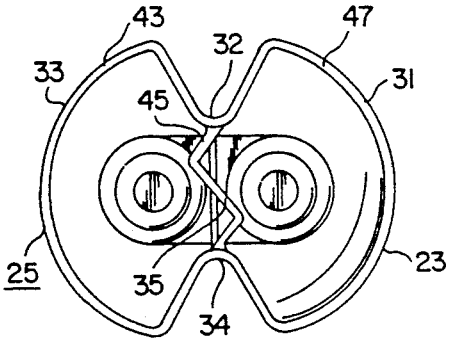
FIG. 7 is an enlarged plan view of the open sealing end of the one piece molded container assembly of the invention taken along the line 7,7 of FIG. 5.

The two arcuate outer walls 31 and 33 are separated by a common wall segment 35 as shown in FIGS. 4–8. The wall segment 35 is constructed to have a first length prior to filling and a second longer length after the filling end 17 is sealed. In the preferred embodiment shown in FIG. 4, common wall segment 35 is pleated to define the first length. The outer arcuate walls 31 and 33 are joined at each end or junction to the common wall segment 35. These junctions for axially aligned junctions which are pivotal in operation. As shown in FIG. 7 particularly, junctions 32 and 34 are formed where the two ends of arcuate outer walls 31 and 33 join to the common wall segment 35.

In FIGS. 5 and 6, it is clear to see that the common wall segment 35 extends from the filling end 17 completely between containers 23 and 25 up into the discharge end 15, shown as wall segment 37. Thus the contents of the two compartments 23 and 25 do not contact one another until after the contents have been discharged.

Figure 2:
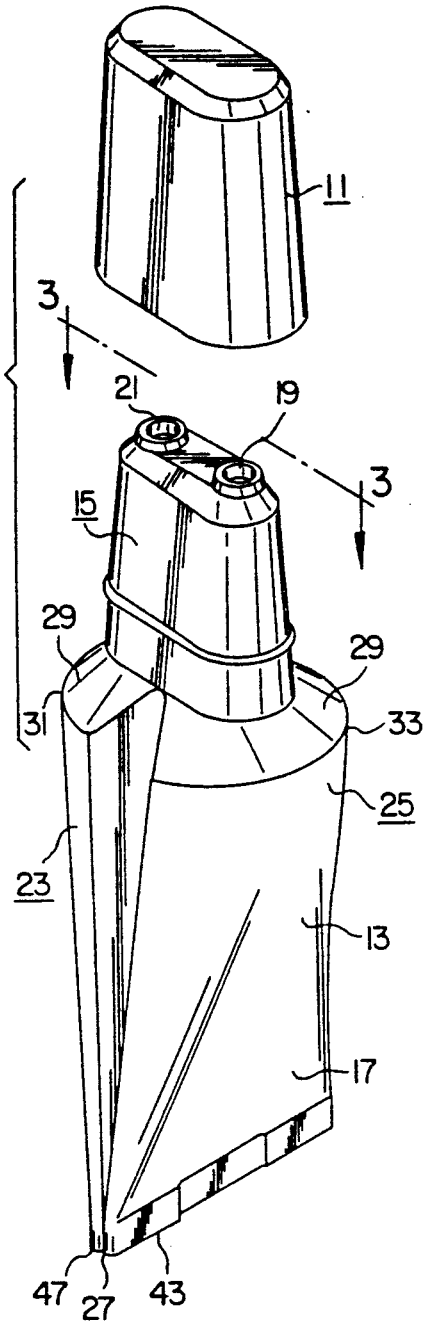
FIG. 2 is an exploded isometric view of the dual chamber container assembly shown in FIG. 1 with the closure member removed to show details of the dual discharge nozzle.
Figure 3:
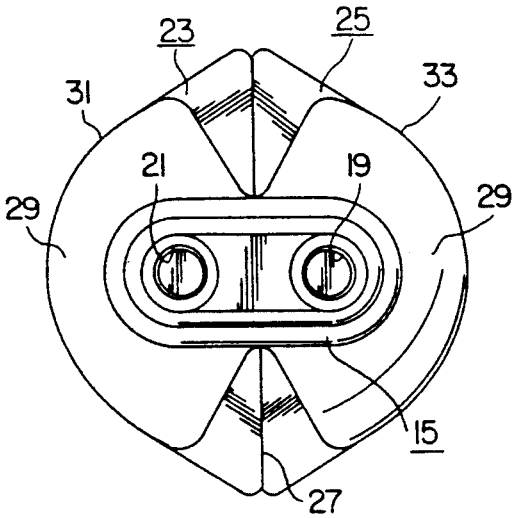
FIG. 3 is an enlarged plan view taken on the line 3,3 of FIG. 2, and showing the symmetrical design of the tube geometry.
Figure 8:
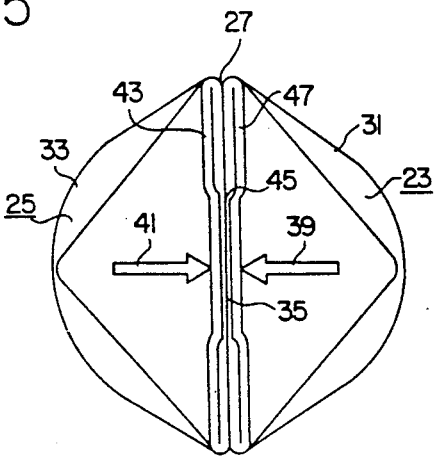
FIG. 8 is a view similar to FIG. 7 and showing the terminal ends of the outer arcuate side walls pressed inwardly to form a straight line seal.

Once the contents have been placed in compartments 23 and 25, the filling end 17 is sealed by forcing the outer arcuate walls 31 and 33 together at the filling end 17 in the direction of arrows 39 and 41, shown in FIG. 8. The force of bringing outer arcuate walls 31 and 33 together as shown causes a straight line seal 27. This straight line seal 27 is formed from the end 43 of wall 33, the end 45 of common wall segment 35 and the end 47 of wall 31. With pressure and heat, the seal is completed and the container assembly takes the ready to use form shown in FIGS. 1 and 2, for example.

In prior art designs where two adjacent compartments are separated by a common wall, there is a great deal of pressure on the common wall as the side walls are forced together to make the seal. When the two compartments are relatively large and flexible, this is not a serious problem, although the seal is not always straight and appealing to the consumer. When the compartments are not as large, the force on a straight wall segment is so great that either the container assembly cannot be closed and sealed safely and effectively or the straight wall segment is ruptured or destroyed.

Efforts to overcome this problem with different shapes for the two compartments have not met with success since the compartments need to have a certain size in order to contain the appropriate quantities of medicines and the like. Some shapes actually prevent the effective and efficient squeezing discharge which users of single compartment tube assemblies have come to know and expect.

The present invention is the only design which preserves the common expectations of users of single compartment tubes while also giving a superior seal. When the tube is used, the tapered sidewalls of the two compartments 23 and 25 form bellows means, whereby the pivotal junctions 32 and 34 allow squeezing pressure to force all of the contents out the discharge ports 19 and 21.

While particular embodiments of the present invention have been illustrated and described, it is not intended to limit the invention, except as defined by the following claims.

I claim:

1. A dual compartment container assembly, comprising:

a container having adjacent compartments separated by a common wall segment, a discharge end on said container operable to permit dispensing of the contents of said container, and a filling end on said container which is sealed after contents are placed in said compartments;

wherein each said chamber includes an arcuate outer wall having a chord of a length greater than the width, of said common wall, said arcuate outer wall being connected to each end of said common wall by two side walls via a pivotal junction and forming a hinge at the junctures of said outer side walls; and said common wall segment being pleated to have a first length prior to filling and a second unpleated longer length after said filling end is sealed to form a straight line seal at said filling end, said second length of said common wall segment being less then the length of said filling end after sealing.

2. The assembly of claim 1, wherein said straight line seal is a heat seal.

3. A dual compartment container assembly, comprising:

a container having adjacent compartments defined by a common wall segment and a pair of outer arcuate walls, said container including a discharge end operable to permit dispensing of the contents of said adjacent compartments and a filling end which is sealed after said contents are placed in said adjacent compartments;

said common wall segment being pleated to have a first width prior to filling said adjacent compartments and a second, straightened unpleated width after said sealing of said filling end, said second width being greater than said first width at the same cross-section;

said outer arcuate walls and said common wall segment terminating axially at said filling end to provide a filling end seal region such that pressure forming a seal at said filling end joins the terminal ends of said outer arcuate walls to form a straight line seal, said filling end seal region includes the terminal end of said common wall segment, said straight line seal being greater in width than said second, straightened unpleated width of said common wall segment; and said outer arcuate walls include a pair of sidewalls extending arcuately from said common wall segment, said pair of sidewalls being connected to said common wall segment by diametrically aligned pivotal junctions, said sidewalls and said arcuate walls tapering outwardly from said straight line seal to form a bellows, whereby squeezing said bellows dispenses the contents and allows said sidewalls to pivot at the pivotal junctions to reduce stress induced in the common wall segment during dispensing.

4. The apparatus of claim 3, wherein said bellows extends from said filling end seal region to said discharge end such that the terminal portion of said bellows is included in said straight line seal.

5. The assembly of claim 4, wherein said straight line seal is a heat seal.

* * * * *